US005228203A

United States Patent [19]

Hahn

[11] Patent Number: 5,228,203

[45] Date of Patent: Jul. 20, 1993

[54] HIGH-SPEED TANDEM CAN OPENER

[76] Inventor: Perry Hahn, 5909 61st Ave., Riverdale, Md. 20737

[21] Appl. No.: 981,205

[22] Filed: Nov. 25, 1992

[51] Int. Cl.[5] ..... B67B 7/46

[52] U.S. Cl. ..... 30/418; 30/417

[58] Field of Search ..... 30/417, 418, 400, 426, 30/427, 430; 82/56

[56] References Cited

U.S. PATENT DOCUMENTS

| | | | |
|---|---|---|---|
| 1,528,178 | 3/1925 | Anderson | 30/418 |
| 1,678,244 | 7/1928 | Davis et al. | 30/417 |
| 1,687,582 | 10/1928 | Noble | 30/418 |
| 2,486,314 | 10/1949 | Montgomery | 30/417 |
| 4,251,917 | 2/1981 | Peres | 30/417 |

FOREIGN PATENT DOCUMENTS

| | | | |
|---|---|---|---|
| 697868 | 11/1964 | Canada | 30/418 |
| 657962 | 5/1929 | France | 30/418 |

*Primary Examiner*—Frank T. Yost
*Assistant Examiner*—Hwei-Siu Payer
*Attorney, Agent, or Firm*—Harry Williams

[57] ABSTRACT

An automatic can opener having a motor-driven cutter wheel which cooperates with two stabilizing wheels or runners for performing a can-opening or cutting operation on two cans simultaneously. The single cutting wheel is directly inline with the motor armature axis and acts as the sole driving element for both rotating and cutting into the two cans that are held in rotational stability by the respective stabilizing wheels acting on opposite sides of the cans from the cutting wheel.

12 Claims, 2 Drawing Sheets

HIGH-SPEED TANDEM CAN OPENER

BACKGROUND OF THE INVENTION

This invention relates to can openers and particularly to automatic can openers for opening food and beverage cans. Under normal conditions an automatic or electrically driven can opener is considered superior to a mechanical can opener for the obvious reason that it facilitates the operation. There are situations, however, in which facility in itself is not enough to render the automatic can opener superior to the mechanical can opener if the speed of opening the can is not significantly enhanced. Commercial situations, for example, in which a large number of cans are required to be opened quickly and efficiently necessarily place as much emphasis on the speed of operation as on its facility of operation. In those situations in which a large number of canned beverages are sold to the consuming public, a need exists for a portable automatic can opener that can be used by a vending operator in the sale and distribution of canned beverages. In such cases, especially when the vendor services a seated spectator to a public event, for example, the vendor must insure the freshness of the beverage or drink by opening the can just before sale and then pouring the contents, as required by law, into a paper cup. Commercial viability of such sales depends in large measure on how fast the vendor can open the can and pour the contents into a cup. If the vendor chooses to use a manually operated can opener for that purpose, he or she will soon incur fatigue if not injury from the prolonged repetition of opening cans for multiple consumers. On the other hand, if the vendor chooses to use the provided opening mechanisms on most beverage cans, he will soon suffer discomfort if not injury to his fingers; and should his fingers survive that kind of punishment, he will soon tire of performing the added step of puncturing an air hole in the can to facilitate pouring. Then again should the vendor use, say, a conventional battery-operated can opener, his ability to perform with speed and quickness will suffer dramatically.

OBJECTS AND SUMMARY OF THE INVENTION

It is a primary purpose and principle object of the present invention to address the aforementioned need and provide a battery-operated automatic can opener that can perform with such efficiency and speed as to justify its use in those environments where a large number of cans must be opened quickly and efficiently.

It is another feature of the present invention to provide an automatic can opener which can operate with both efficiency and speed and which can easily be held and manipulated by one hand.

It is yet another feature of the invention to provide an automatic can opener for speedily opening beverage cans for consumer-spectators, either in their seats or at commercial stands, at such performing events as sporting contests, concerts, exhibitions and so on.

It is still another feature of the present invention to provide a portable and automatic can opener which is simple and efficient in design, light in weight, involving a minimal use of moving parts and which can be operated by one hand.

According to one embodiment of the invention there is provided an automatic can opener having a motor-driven cutter wheel which cooperates with two stabilizing roller wheels that straddle the cutter wheel for performing a can-opening or cutting operation on two cans simultaneously. The single cutter wheel is directly in-line with the motor armature axis and acts as the sole driving mean for both rotating and cutting into the two cans that are held in rotational stability by the respective stabilizing wheel acting on opposite sides of the cans from the cutter wheel.

The invention will be better understood as well as further objects and advantages thereof become more apparent from the ensuing detailed description taken in conjunction with the drawings.

DETAILED DESCRIPTION

Figure 1:
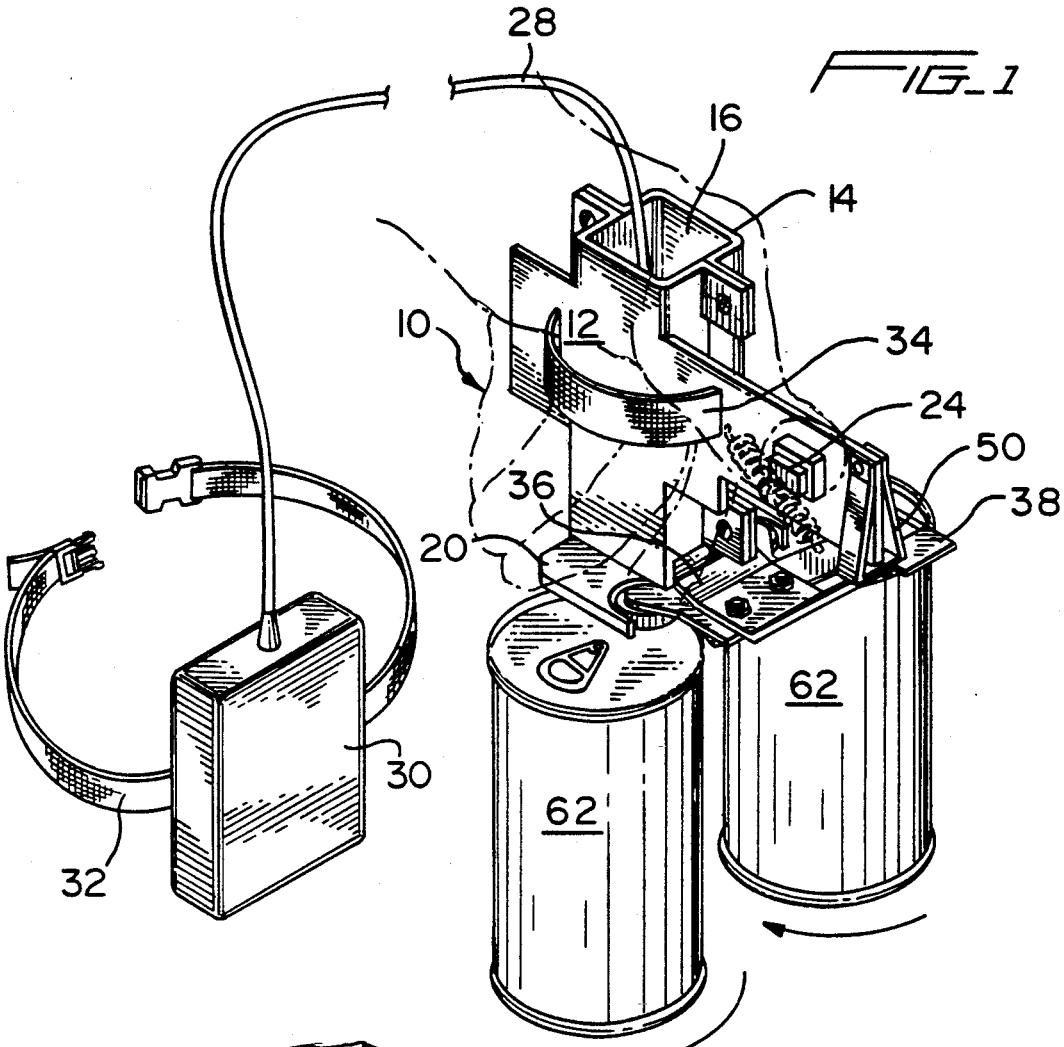
FIG. 1 is a schematic perspective view of the automatic can opener according to the invention.
Figure 2:
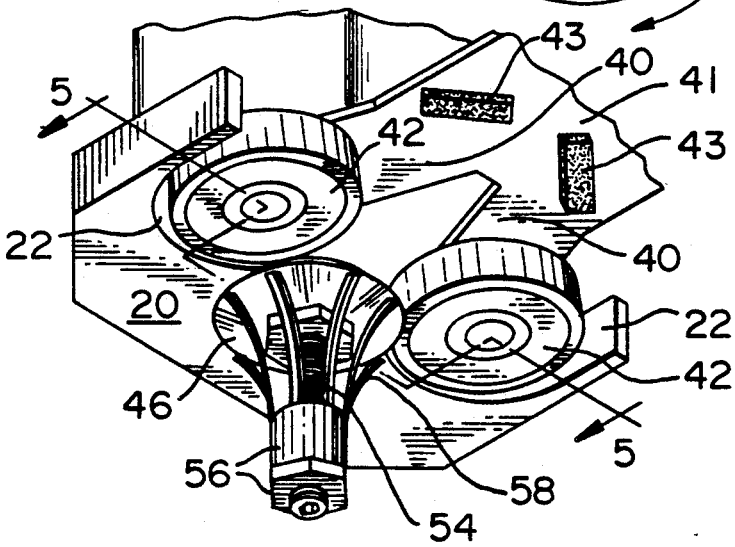
FIG. 2 is a schematic perspective view from the bottom of the device shown in FIG. 1.
Figure 3:
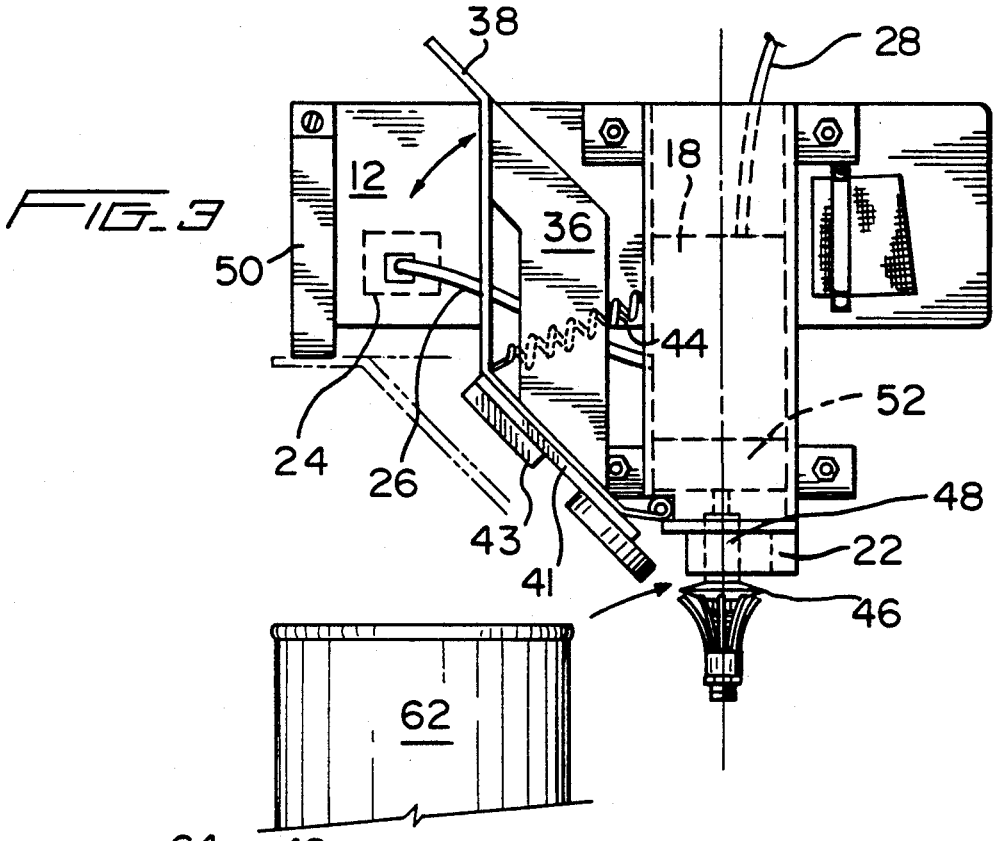
FIG. 3 is a schematic side elevational view of the can opener according to the invention.

Referring now to FIGS. 1-3, there is shown the automatic can-opener 10 according to the invention, in which a housing is formed by a plate structure 12 having a portion thereof turned upward for mating, as by means of suitable screws or bolts, with a complementary portion 14 to thereby form a clamshell housing 16 in which a battery-operated motor 18 (see FIG. 3) is held. Extending along the bottom of the motor housing 16 is a base plate member 20 having two spaced apart scalloped-out portions 22, which will be further discussed below. A switch 24 is provided on the plate 12 and is connected by a suitable cable 26 to the motor 18 in order to control its on-off operation in a well know manner. A power supply cable 28 conventionally connects the motor with a source of energy, such as a battery 30, which can be suitably carried on a belt 32 of the user of the can-opener, for allowing the user freedom of movement or travel, as would be required in a stadium-like environment in which multiple cans of beverages must be opened before sale. To facilitate carrying the automatic can-opener in one hand a finger-strap 34 is provided; in this way the user of the opener can easily carry the opener by inserting his or her middle and ring fingers under the strap to thereby snugly hold the opener while the other hand is free.

Figure 4:
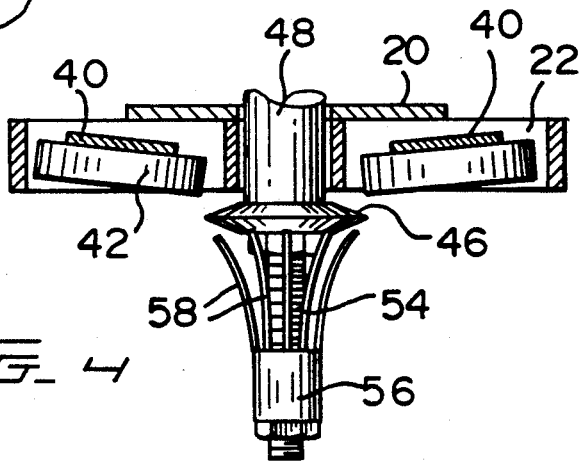
FIG. 4 is a front elevational view partly in cross-section of that part of the can opener according to the invention which features the cutting wheel and the two stabilizing roller wheels.

Pivotally attached to the bottom portion of the clamshell housing 16, as by a suitable hinge structure, is a bracket 36, as best shown in FIG. 3. The pivotal bracket has a handle portion 38 at one end, and at its other end 41 the bracket branches out into two identical arm members 40, each rotatably supporting a stabilizing member, preferably in the form of a roller wheel 42. The stabilizing member may assume a stationary form, such as a runner member in which the wheel 42 would be stationary and against which the rim of the can will be in frictional or rubbing contact. Each of the stabilizing wheels 42 are slightly inclined with respect to a horizontal plane, as shown in FIG. 4, in order to avoid interference with any protrusions on the tops of the cans. Also connected to the bottom side 41 of the bracket 36 are two spaced apart plastic slide members 43 affixed thereto by suitable means, such as rivets or a suitable epoxy cement. The slide members 43 are aligned so that they will be in rubbing contact with the tops of the rims of the cans when the bracket 36 is in its operative position, as will be explained below. As shown in FIG. 3, the bracket 36 is biased by a spring member 44 into an inoperative position, so that the stabilizing wheels 42 are displaced, as shown, from a cutter wheel 46 which is fixedly secured by suitable means to the drive shaft 48 of the motor 18. The cutter wheel 46 is seen to extend beyond the motor housing 16, as shown in FIG. 3. Also, the rotary axis of cutter wheel 46 is co-extensive with the armature axis A of the motor, as shown in FIG. 3.

Figure 5:
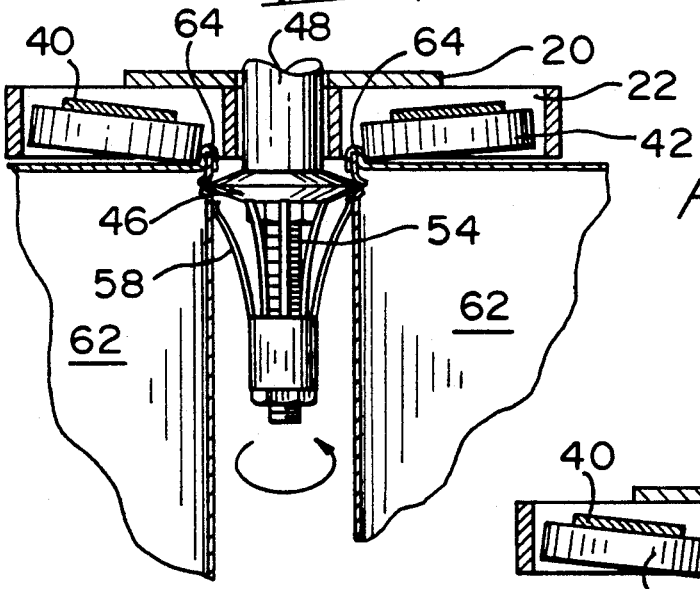
FIG. 5 is the same front elevational view as FIG. 4, except that the device is shown in operation for simultaneously opening two cans.

When the bracket 36 is swung downwardly against the bias of spring 44, the handle 38 passes or snaps past a resilient triangular latch member 50 constructed of spring steel, thus pushing that member laterally aside owing to its resilence and allowing the bottom portion of the latch member to act as a stop for the handle 38, as best shown in FIG. 3. In this way the operative position of the bracket 36 is defined, so that the stabilizing wheels 42 carried thereby are in a position adjacent the cutter wheel 46, that is, both stabilizing wheels straddle the cutter wheel but, of course, do not touch the cutter wheel, as best shown in FIGS. 2, 4 and 5.

The motor shaft 48 is suitably connected to a gear-reduction assembly 52 to thereby transmit a reduced rotary speed from the armature shaft of the motor to the cutting wheel; such gear-reduction assemblies are conventional and need not be discussed any further here, except to incorporate by reference one such assembly described in the U.S. patent to Wang, U.S. Pat. No. 4,763,031.

The drive shaft 48 of the motor is seen to have a threaded extension 54 to which is threaded a bolt member 56. Extending circumferentially from the rim of the bolt member 56 are a plurality of spring finger members 58 whose ends terminate near the cutting edge of the cutter wheel 46. The finger-members 58 act a guide for the cans 62, to be more fully explained below.

In operation, the can opener 10 is held in one hand by curling two or three fingers under the finger-strap 34. The can opener 10 is lowered over the respective tops of a pair of conventional beverage cans, which are situated adjacent each other (as may be encountered in a typical case of canned beverages. The spring fingers 58 guide the cutting edge of the cutter wheel 46 just past (and between) the top rims 64 of the two can 62 until the base plate 20 contacts the top rims 64, as shown in FIG. 1. The can opener is held in position there at the same time as the thumb of the other hand urges the bracket 36 about its pivot until the handle portion 38 passes the laterally movable spring latch member 50. The latch member 50, then, retains the bracket in its operative position, as shown in phantom lines in FIG. 3. In this position the stabilizing wheels 42 are brought into engagement with the inside portions of the rims 64 of the cans 62, as shown in FIG. 5. The cutting edge of the cutter wheel is likewise brought into engagement with the side walls of both the cans simultaneously at a point just below the rims of the cans. At the same time respective bottom portions of the base plate 20 together with the plastic slide members 43 engage in different places the tops of the rim portions 64 of the cans, exerting a downward force on the cans. Together with the just-described downward force on the cans, the torque on the cans caused by the combination of the forces exerted by the cutter wheel 46 and by the stabilizing wheels 42 is counterbalanced; the cans, then, are secured in the correct orientation and are disposed in an operative position with respect to the can opener. At that point, when the cans are held in tight engagement with the cutter wheel, penetration of the cutting edge will take place. The motor is energized by means of pressing the switch 24 with a free finger, and simultaneously the can opener together with the two cans can be lifted form the case of cans (not shown) with one hand while the other hand can be moved to a position underneath the cans. The motor is kept energized, and the cans are loosely held until the cutter wheel drives the respective cans full circle in the directions shown by the arrows in FIG. 1 and so severs the tops from the cans, which are held by the free hand. At that point the on-off switch 24 is released and the contents of the cans are simultaneously emptied into a suitable pair of cups and distributed to the consumers.

The foregoing relates to a preferred exemplary embodiment of the present invention, it being understood that other embodiments and variants thereof are possible within the scope of the invention, the latter being defined by the appended claims.

What is claimed and desired to be secured by Letters Patent of the United States is:

1. An automatic can opener for opening simultaneously a pair of conventional cans, comprising a motor having a drive shaft, a portable source of energy for said motor, a housing means for said motor, a cutting wheel affixed to the drive shaft of said motor and extending beyond said housing means, switch means on said housing means for energizing and deenergizing said motor, a bracket means rotatably supporting a pair of spaced apart stabilizing means, and said bracket means being pivoted to said housing means for being moved into an operative position in which said pair of stabilizing means straddle said cutting wheel, whereby each stabilizing means of said pair of stabilizing means is in contact with respective rim portions of said pair of cans, and said cutting wheel is in cutting engagement with respective side portions of said cans.

2. An automatic can opener according to claim 1, further comprising a finger-strap means for enabling manual support of said can opener.

3. An automatic can opener according to claim 1, further comprising a guide means disposed on said drive shaft adjacent said cutter wheel for guiding said respective side portions of said pair of cans into respective positions adjacent said cutting wheel.

4. An automatic can opener according to claim 3, wherein said guide means comprise resilient finger means surrounding said drive shaft and having free end portions terminating near the cutting edge of said cutting wheel.

5. An automatic can opener according to claim 1, further comprising releasable-retention means for releasably securing said bracket means in said operative position.

6. An automatic can opener according to claim 1, further comprising a gear reduction means disposed between said drive shaft and said motor.

7. An automatic can opener according to claim 1, further comprising a body-strap means for carrying said portable source of energy on a portion of a person's body.

8. An automatic can opener according to claim 1, wherein said bracket means comprises a pair of arm members for respectively supporting said pair of stabilizing means.

9. An automatic can opener according to claim 1, further comprising a spring means for biasing said bracket means into an inoperative position.

10. An automatic can opener according to claim 1, further comprising spaced apart contact means in addition to said stabilizing means on said bracket means for engaging in sliding contact with said respective rim portions of said pair of cans.

11. An automatic can opener for opening simultaneously a pair of conventional cans, comprising a motor having a drive shaft, a portable source of energy for said motor, a housing means for said motor, a cutting wheel affixed to the drive shaft of said motor, switch means on said housing means for energizing and deenergizing said motor, a bracket means rotatably supporting a pair of spaced apart stabilizing means, said bracket means being pivoted to said housing means for being moved into an operative position in which said pair of stabilizing means straddle said cutting wheel, whereby each stabilizing means of said pair of stabilizing means is in contact with respective rim portions of each can of said pair of cans, and said cutting wheel is in cutting engagement with respective side portions of said each can, and guide means disposed on said drive shaft adjacent said cutter wheel for guiding said respective side portions of said pair of cans into respective positions adjacent said cutting wheel.

12. An automatic can opener for opening simultaneously a pair of conventional cans, comprising support means for holding said cans in a generally tandem but spaced apart relationship, a motor-operated cutter means supported by said support means and disposed in the space between said cans for engaging the sides of said cans simultaneously, and switch means for energizing and deenergizing said motor-operated cutter means.

* * * * *